US007114913B2

(12) United States Patent
Coker

(10) Patent No.: US 7,114,913 B2
(45) Date of Patent: Oct. 3, 2006

(54) LUBRICANT-COOLED GAS COMPRESSOR

(75) Inventor: Terrence Edward Coker, High Wycombe (GB)

(73) Assignee: Compair, (GB)

( * ) Notice: Subject to any disclaimer, the term of this patent is extended or adjusted under 35 U.S.C. 154(b) by 68 days.

(21) Appl. No.: 10/496,779

(22) PCT Filed: Dec. 6, 2002

(86) PCT No.: PCT/GB02/05525

§ 371 (c)(1),
(2), (4) Date: May 25, 2004

(87) PCT Pub. No.: WO03/048575

PCT Pub. Date: Jun. 12, 2003

(65) Prior Publication Data

US 2005/0008513 A1 Jan. 13, 2005

(30) Foreign Application Priority Data

Dec. 7, 2001 (GB) ..... 0129341.4
Dec. 7, 2001 (GB) ..... 0129343.0

(51) Int. Cl.
*F03B 15/02* (2006.01)
*F04B 39/06* (2006.01)

(52) U.S. Cl. ..... 415/47; 415/112; 251/11; 417/228

(58) Field of Classification Search ..... 415/47, 415/112; 251/11; 137/468; 236/34.5, 100; 417/228

See application file for complete search history.

(56) References Cited

U.S. PATENT DOCUMENTS

| | | | | |
|---|---|---|---|---|
| 2,470,655 A | | 5/1949 | Shaw | 418/1 |
| 3,118,648 A | * | 1/1964 | Campbell | 251/77 |
| 3,147,912 A | * | 9/1964 | Stelzer et al. | 417/228 |
| 3,886,761 A | * | 6/1975 | Santini | 62/217 |
| 4,189,095 A | * | 2/1980 | Monigold et al. | 236/92 R |
| 4,289,461 A | * | 9/1981 | van Oorschot et al. | 418/84 |
| 4,341,506 A | | 7/1982 | Klein | 417/362 |
| 4,342,421 A | | 8/1982 | Widdowson | 236/92 B |
| 4,475,684 A | | 10/1984 | Garlick | 236/12.14 |
| 4,537,346 A | * | 8/1985 | Duprez | 236/34.5 |
| 4,605,357 A | | 8/1986 | Keith | 417/228 |
| 5,018,665 A | * | 5/1991 | Sulmone | 236/93 A |
| 5,318,151 A | | 6/1994 | Hood | 184/6.1 |
| 6,082,971 A | | 7/2000 | Gunn | 417/32 |
| 6,719,546 B1 | * | 4/2004 | Foerster | 418/84 |

FOREIGN PATENT DOCUMENTS

| | | |
|---|---|---|
| DE | 19646295 | 5/1998 |
| EP | 00152257 | 8/1985 |
| EP | 00752362 | 1/1997 |
| EP | 02000346215 | 12/2000 |

(Continued)

*Primary Examiner*—Edward K. Look
*Assistant Examiner*—Nathan Wiehe
(74) *Attorney, Agent, or Firm*—Clifford Kraft

(57) ABSTRACT

In a lubricant-cooled gas compressor (10) the temperature of separated lubricant returned to the air-side (11) is monitored by a thermostatically controlled restrictor valve (22) which minimises the flow of returned lubricant when temperature is low as on start up or when running on reduced load but increases the flow as the lubricant temperature increases. This will minimise he condensation of water from indrawn air when the temperature of the compressed air is too low to retain the water as vapour, so that the returned lubricant is contaminated with water which will damage the moving components of the air-end.

11 Claims, 2 Drawing Sheets

FOREIGN PATENT DOCUMENTS

Figure 1:
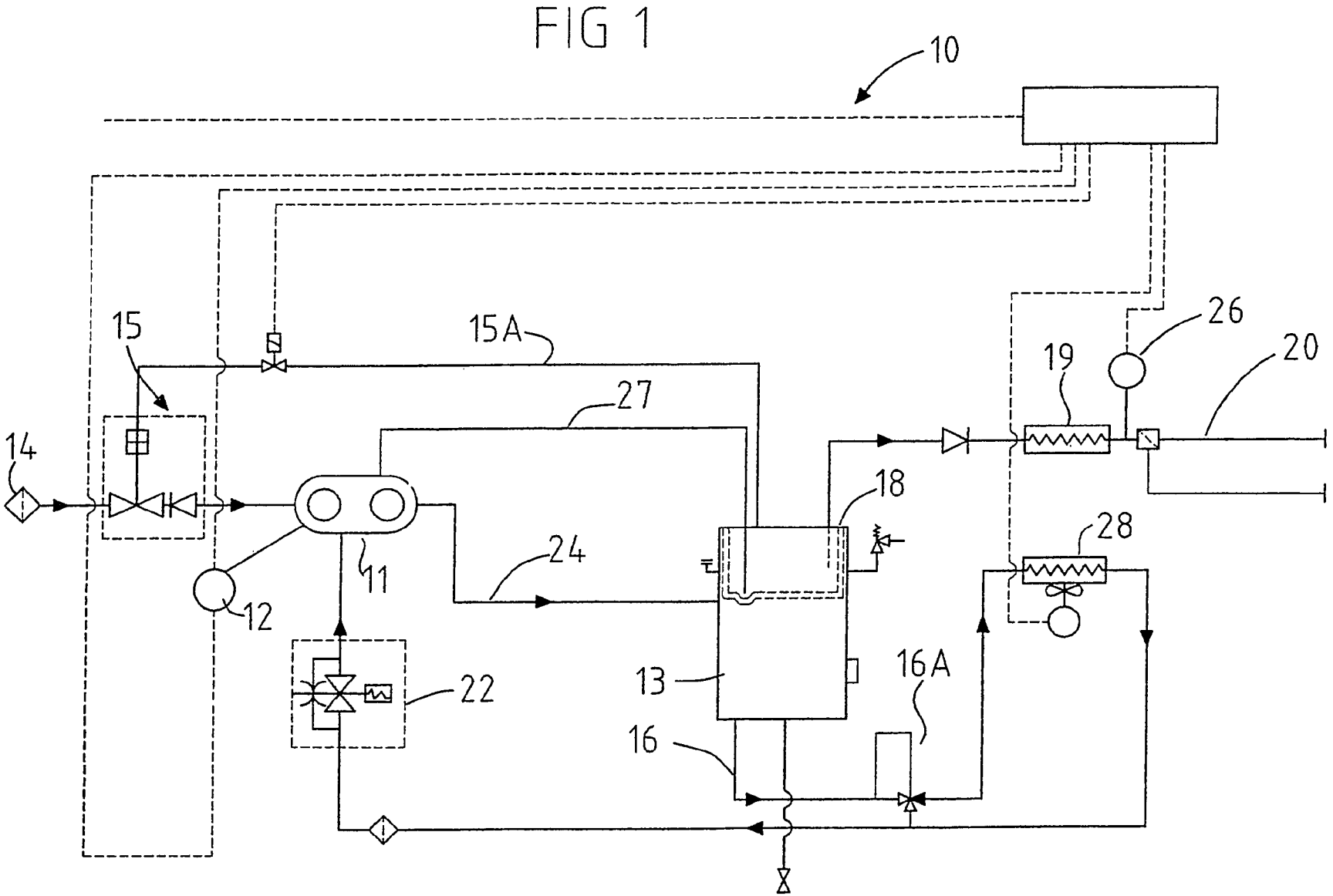

| | | |
|---|---|---|
| GB | 204748 | 9/1923 |
| GB | 2021971 | 12/1979 |
| GB | 2317217 | 3/1998 |

* cited by examiner

LUBRICANT-COOLED GAS COMPRESSOR

This invention relates to an improved method of operating a lubricant-cooled gas compressor and to a lubricant-cooled gas compressor adapted to carry out the method.

A number of gas compressors, particularly air compressors, discharge a mixture of gas and a lubricant. Examples of such compressors are of the piston type, the sliding vane type or screw compressors in which air is compressed between male and female helical rotors at the so-called "air-end". In all such lubricant-cooled compressors lubricant such as oil is introduced to the compressor together with incoming gas and is then separated downstream of the compressor and recycled. The lubricant serves to cool the compressed gas and the machinery of the compressor and to lubricate the latter. In the case of a screw compressor it also provides a seal between the rotors.

A major problem encountered in the operation of lubricant-cooled air compressors is that of condensation of water from the indrawn air. It is not practicable to dry the incoming air, which will precipitate moisture when compressed unless temperatures are maintained high enough for the water to remain as vapour. During normal operation the temperature of the compressed air will be high enough to prevent substantial precipitation but at start up or when the compressor is idling (because of a temporary reduction in the demand for compressed air) temperatures will drop below the dew point of the compressed air so that water will collect in the separator and form an emulsion with the lubricant. When this is returned to the compressor lubrication will be adversely affected, causing high maintenance and a shortened life for the compressor.

A principal object of the present invention is to address the problem of condensation when operating a lubricant-cooled gas compressor.

In accordance with one aspect of the present invention there is provided a method of operating a lubricant-cooled gas compressor which discharges a mixture of lubricant and compressed gas, and means for separating the lubricant from the compressed air downstream of the air-end and for returning the separated lubricant to the compressor, wherein the return flow of lubricant to the compressor is controlled in accordance with the temperature of the lubricant such that said flow is restricted when said temperature is below a predetermined value and increased when said temperature is above said predetermined value.

The said return flow of lubricant is preferably controlled to be proportional to variations of said temperature.

Preferably the temperature of the return flow of lubricant is sensed to determine the temperature of the lubricant.

In accordance with another aspect of the present invention there is provided a lubricant-cooled gas compressor adapted to discharge a mixture of lubricant and compressed gas and provided with means for separating the lubricant downstream of the compressor and with means for returning the separated lubricant to the compressor, wherein temperature sensitive means is provided for varying the return flow of lubricant to the compressor in response to variation in the temperature of the lubricant such that the return flow of lubricant to the compressor is restricted when the temperature of the lubricant falls and is increased when the temperature of the lubricant rises.

By this arrangement temperature rise of the compressor on start up will be accelerated and will not be allowed to fall proportionally to a reduction in the speed of operation of the compressor or when running on reduced load. The maintenance of high temperature substantially throughout the operation of the compressor will reduce the incidence of condensation and thus protect the moving components of the assembly.

A thermostatically controlled restrictor valve may be located in a lubricant return line from the separating means to the compressor, the valve being adapted to control the flow of the returning lubricant according to the temperature sensed by the thermostat.

Preferably the thermostat is immersed in the return lubricant flow.

The restrictor valve may comprise a housing having a lubricant inlet and a lubricant outlet, the outlet communicating with a cylindrical chamber within the housing which is coaxial with, intermediate the ends of and of greater diameter than a bore within the housing communicating with the inlet, a sleeve moveable axially of the bore whereby an opening in the wall of the sleeve may be brought into or out of register with the chamber and a thermostatic device within the bore which will respond to changes in the temperature of lubricant passing through the housing thereby to displace the sleeve to vary the area of said opening which is exposed to the chamber.

The thermostatic device may comprise a cylinder moveable with the sleeve, a piston fixed at one end relative to the housing and a wax within the cylinder at the free end of the piston, the wax being of the kind which increases in volume as it liquifies in response to an increase in temperature.

By-pass means may be provided by passing the temperature sensitive means, the by-pass means being adapted to ensure a minimum return flow of lubricant to the compressor independently of the temperature sensitive means.

The by-pass means may comprise a by-pass duct within the housing which directly communicates the inlet with said chamber.

The by-pass duct may have a restriction and the restriction may be adjustable.

In accordance with another aspect of the present invention there is provided a retro-fit device for incorporation in a lubricant-cooled compressor, the compressor being of the kind which discharges a mixture of lubricant and compressed gas and wherein means is provided for separating the lubricant from the compressed gas downstream of the compressor and for returning the separated lubricant to the compressor, the device comprising a housing having an inlet and an outlet whereby it may be incorporated in the line between the separating means and the compressor by which lubricant is returned to the compressor, a bore between the inlet and outlet, a thermostatically controlled restrictor valve within the bore located so that a temperature sensitive element of the thermostat is exposed, in use, to the temperature lo of lubricant flowing between the inlet and outlet, and a sleeve moveable in the bore by the valve whereby an opening in the sleeve will control the outlet and restrict said flow when said temperature falls and increase said flow when said temperature increases.

Preferably the outlet communicates with a cylindrical chamber within the housing which is coaxial with, intermediate the ends of and of greater diameter than said bore, and wherein the sleeve is moveable axially of the bore whereby said opening in the wall of the sleeve may be brought into or out of register with the chamber, the thermostat being responsive to changes in the temperature of lubricant passing though the bore thereby to displace the sleeve to vary the area of said opening which is exposed to the chamber.

Figure 2:
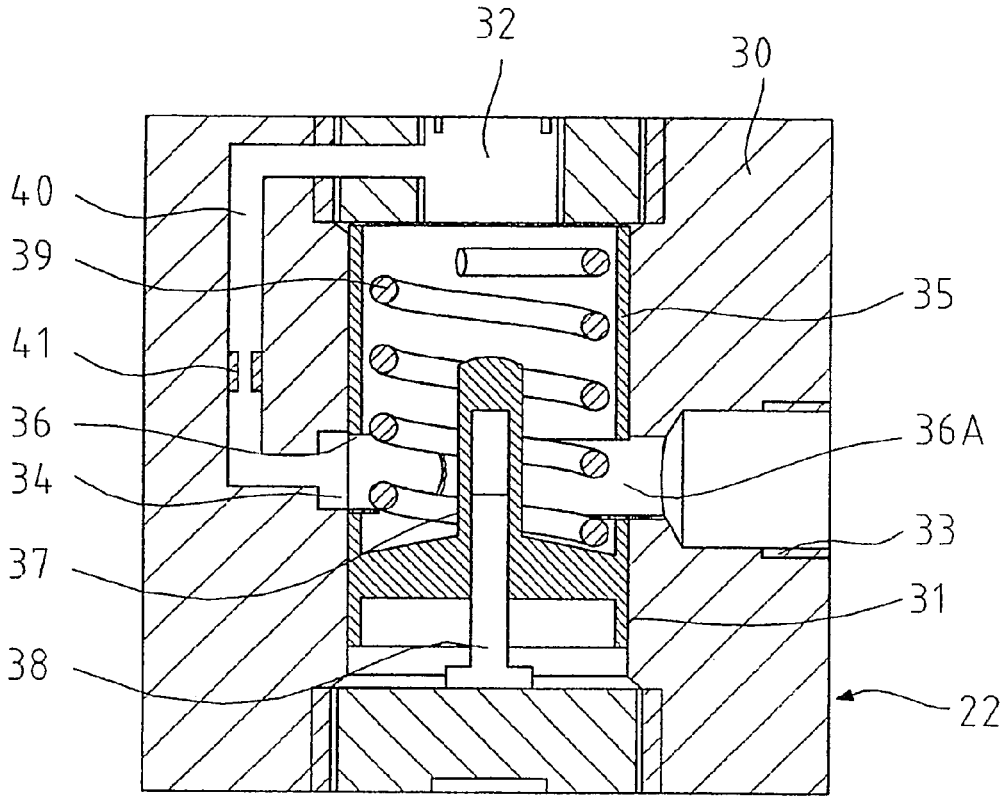
Figure 3:
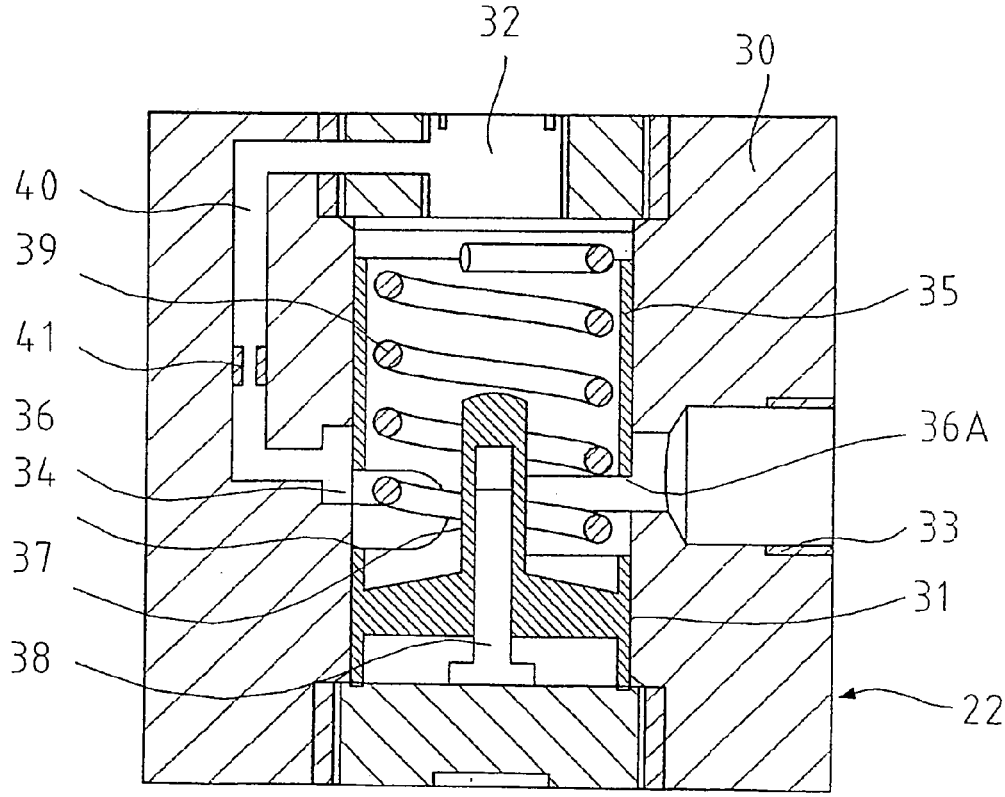

A preferred embodiment of the present invention will now be described by way of non-limitative example with reference to the accompanying drawings, in which:

FIG. 1 is a schematic representation of a screw compressor according to the present invention, and FIGS. 2 and 3 are similar sectional elevations of a thermostatically controlled restrictor valve used in the compressor of FIG. 1 showing the restrictor valve respectively in a fully open and in a partially closed condition.

The screw compressor 10 illustrated in FIG. 1 comprises a screw compressor 11 (known as the air-end) for compressing a gas such as air. A motor 12 drives the rotors of the air end 11.

Air is taken into the air-end 11 via a gas intake filter 14. The quantity of air intake is controlled via a suction regulator 15 which is connected by a control line 15*a* to a reclaimer 13.

The discharge of the pressurised compressed air from the air-end 11 contains a large quantity of lubricant. This lubricant has to be separated from the compressed air before the latter passes into use. The compressed air and lubricant mixture is therefore discharged from the air-end 11 to the reclaimer 13 via an appropriate duct 24.

The separation of the gas and lubricant is achieved in two stages; primary separation of the lubricant and gas is carried out within the reclaimer 13 and final separation is completed through a special filter 18 which in the example shown is integral with the reclaimer 13 although it may be fitted downstream of the reclaimer 13. As is known per se the line 16 between the reclaimer 13 and the air-end 11 passes through a lubricant cooler 28. A by-pass 16A controlled by a thermostatic valve is provided which diverts the lubricant through the by-pass when the temperature of the lubricant from the reclaimer 13 is below a predetermined operating temperature.

The fully cleaned gas is subsequently passed through an after cooler 19 before passing to the plant discharge 20 and into use. A pressure transducer 26 responds to the pressure in the customer's gas main to energise the control system as and when required.

A small amount of the reclaimed lubricant is injected directly to the air end 11 through a scavenge pipe 27 but the bulk of the reclaimed lubricant returns from the reclaimer 13 and filter 18 to the air end 11 through the line 16.

In accordance with the present invention a thermostatically controlled restrictor valve 22 (FIGS. 2 and 3) is incorporated in the lubricant return line 16. The restrictor valve 22 comprises a housing 30 having a blind bore 31 communicating at its open end with an inlet 32 of the housing. An outlet 33 of the housing communicates with a cylindrical chamber 34 of greater diameter than the bore 31 and surrounding the same intermediate its ends. Axially slideable within the bore 31 is a sleeve 35 which has circumferential slit-like openings 36 and 36A in the same plane intermediate its ends. As shown in FIG. 2, when the sleeve 35 is in a fully raised position within the bore 31 the openings 36 and 36A are fully in register with the chamber 34 and the flow of lubricant between the inlet 32 and the outlet 33 of the housing is substantially unirestricted by the sleeve 35. When the sleeve 35 is fully lowered in the bore 31 (FIG. 3) on the other hand it restricts the flow of lubricant into the chamber 34 from the inlet 32.

Movement of the sleeve 35 is under the control of a thermostatic device which comprises a cylinder 37 integral with one end region of the sleeve and a piston 38 fixed relative to the blind end of the bore 31. Between the free end of the piston 38 and the blind end of the cylinder 37 is a capsule (not shown) of a wax which increases in volume as its temperature rises and it liquifies and decreases in volume as it solidifies as its temperature decreases. Because the wax is located where it will be exposed to the temperature of the lubricant flowing between the inlet 32 and outlet 33 of the housing as the temperature of the lubricant increases the sleeve 35 will be lifted from the position of FIG. 3 to the position of FIG. 2, thus increasing the flow of lubricant through the housing 30. Conversely as the temperature of the lubricant falls and the wax solidifies and reduces in volume a compression spring 39 will urge the sleeve 35 from the position of FIG. 2 to the position of FIG. 3, thus restricting lubricant flow through the housing 30.

To ensure that there is always a minimum flow of lubricant through the housing 30 irrespective of the position of the sleeve 35 a by-pass line 40 is provided in the housing directly connecting the inlet 32 with the chamber 34. This safeguards against any malfunctioning or blockage of the sleeve 35 such as to cut off the flow of lubricant altogether or reduce it below a minimum level which will not adequately lubricate the air-end. If necessary the by-pass line 40 has a restriction 41, which may be adjustable.

Application of the present invention to a screw compressor has been described by way of example but the invention is also applicable to other gas compressors which discharge a mixture of compressed gas and a lubricant, such as compressors of the piston or sliding vane type.

The invention claimed is:

1. A lubricant-cooled gas compressor (11) adapted to discharge a mixture of lubricant and compressed gas and provided with means (13) for separating the lubricant downstream of the compressor (11) and with a return line (16) for returning the separated lubricant to the compressor (11), characterized in that the return line (16) is controlled by a restrictor valve (22) which is mechanically operated by a thermostat (37,38) immersed in lubricant in the return line (16), the arrangement being such that the return flow of lubricant to the compressor (11) is restricted when the temperature of the lubricant falls and is increased when the temperature of the lubricant rises; the compressor (11) characterized in that the restrictor valve (22) comprises a housing (30) having a lubricant inlet (32) and a lubricant outlet (33), the outlet communicating with an annular chamber (34) within the housing (30) which is coaxial with, intermediate the ends of and of greater diameter than a bore (31) within the housing communicating with the inlet (32), a sleeve (35) moveable axially of the bore (31) whereby an opening (36,36A) in the wall of the sleeve (35) may be brought into or out of register with the chamber (34) and the thermostat is a thermostatic device (37,38) within the bore (3l) which will respond to changes in the temperature of lubricant passing through the housing (30) thereby to displace the sleeve (35) to vary the area of said opening (36,36A) which is exposed to the chamber (34).

2. A compressor as claimed in claim 1, characterized in that the thermostatic device comprises a cylinder (37) moveable with the sleeve (35), a piston (38) fixed at one end relative to the housing (30) and a wax within the cylinder (37) at the free end of the piston (38), the wax being of the kind which increases in volume as it liquefies in response to an increase in temperature.

3. A compressor as claimed in claim 1 characterized in that a by-pass means (40) is provided by bypassing the thermostat (37,38), the by-pass means being adapted to ensure a minimum return flow of lubricant to the compressor (11) independently of the thermostat (37,38).

4. A compressor as claimed in claim 3 characterized in that the by-pass means comprises a by-pass duct (40) within the housing (30) which directly communicates the inlet (32) with said chamber (34).

5. A compressor as claimed in claim 4, characterized in that the by-pass duct (40) has a restriction (41).

6. A compressor as claimed in claim 5, characterized in that the restriction (41) is adjustable.

7. A retro-fit device (22) for incorporation in a lubricant-cooled compressor (10), the compressor being of the kind which discharges a mixture of lubricant and compressed gas, means (13) being provided for separating the lubricant from the compressed gas downstream of the compressor (11) and a return line (16) for returning the separated lubricant to the compressor (11) and a return line (16) for returning the separated lubricant to the compressor (11), characterized in that the device (22) comprises a housing (30) having an inlet (32) and an outlet (33) whereby it may be incorporated in the return line (16), a bore (31) between the inlet (32) and the outlet (33), a thermostatically controlled restrictor valve (35) within the bore (31) located so that a temperature sensitive element of the thermostat (37,38) is exposed, in use, to the temperature of lubricant flowing between the inlet (32) and outlet(33), the valve comprising a sleeve (35) moveable in the bore (31) by the thermostat (37,38) whereby an opening (36,36A) in the sleeve will control the outlet (33) and restrict said flow when said temperature falls and increase said flow when said temperature increases.

8. A device as claimed in claim 7, characterized in that the outlet (33) communicates with a cylindrical chamber (34) within the housing (30) which is coaxial with, intermediate the ends of and of greater diameter than said bore (31), the sleeve (35) being movable axially of the bore (31) whereby said opening (36,36A) in the wall of the sleeve (35) may be brought into or out of register with the chamber (34), the thermostat (37,38) being responsive to changes in the temperature of lubricant passing through the bore (31) thereby to displace the sleeve to vary the area of said opening (36,36A) which is exposed to the chamber (34).

9. A device as claimed in claim 8 characterized in that a by-pass duct (40) is provided in the housing (30) which directly communicates the inlet (32) with said chamber (34).

10. A device as claimed in claim 9, characterized in that the by-pass duct (40) has a restriction (41).

11. A compressor as claimed in claim 10, characterized in that the restriction (41) is adjustable.

* * * * *